US007646261B2

(12) United States Patent
Kirkeby

(10) Patent No.: US 7,646,261 B2
(45) Date of Patent: Jan. 12, 2010

(54) VERTICAL INTER-DIGITAL COUPLER

(75) Inventor: Niels H. Kirkeby, Jamesville, NY (US)

(73) Assignee: Anaren, Inc., East Syracuse, NY (US)

( * ) Notice: Subject to any disclaimer, the term of this patent is extended or adjusted under 35 U.S.C. 154(b) by 290 days.

(21) Appl. No.: 11/419,091

(22) Filed: May 18, 2006

(65) Prior Publication Data

US 2007/0120621 A1 May 31, 2007

Related U.S. Application Data

(60) Provisional application No. 60/715,696, filed on Sep. 9, 2005.

(51) Int. Cl.
*H01P 5/12* (2006.01)

(52) U.S. Cl. ..... 333/112; 333/118

(58) Field of Classification Search ..... 333/112, 333/118

See application file for complete search history.

(56) References Cited

U.S. PATENT DOCUMENTS 3,371,284 A * 2/1968 Engelbrecht ..... 330/286
3,999,150 A * 12/1976 Caragliano et al. ..... 333/116
5,262,740 A 11/1993 Willems
5,689,217 A * 11/1997 Gu et al. ..... 333/116
6,133,806 A 10/2000 Sheen
6,198,374 B1 3/2001 Abel
6,208,220 B1 * 3/2001 Logothetis ..... 333/116
6,292,070 B1 9/2001 Merrill
6,407,647 B1 6/2002 Apel et al.
6,437,658 B1 8/2002 Apel et al.
6,483,397 B2 11/2002 Catoiu
6,515,557 B1 2/2003 Wangsvick et al.
2004/0090286 A1 5/2004 Runyon
2004/0263281 A1 12/2004 Podell

OTHER PUBLICATIONS

Wen Pin Ou, "Design Equations for an Interdigitated Directional Coupler",Feb. 1975,IEEE,"IEEE Transactions on Microwave Theory and Techniques" p. 253-255.*

Uysal,Sener; "Sum-Difference Circuits Using 0 dB and −3 dB Co-Directional Couplers for Hybrid Microwave and Mimic Circuit Applications"; Jun. 1-5, 1992, IEEE, Microwave Symposium Digest vol. 2, pp. 937-940.*

Hiroaki Tanaka, et al.; Miniaturized 90 Degree Hybrid Coupler Using High Dielectric Substrate for QPSK Modulator; 1996 IEEE MTT-S Digest; pp. 793-796;Jun. 1996;IEEE; Nagaokakyo, Kyoto, Japan.

(Continued)

*Primary Examiner*—Benny Lee
*Assistant Examiner*—Gerald Stevens
(74) *Attorney, Agent, or Firm*—Daniel P. Malley; Bond, Schoeneck & King, PLLC

(57) ABSTRACT

The present invention is directed to a coupler structure that includes a first port, a second port, a third port, and a fourth port. L first transmission line layers are disposed in the structure. Each first transmission line layer includes a first transmission line conforming to a predetermined geometric configuration. The first transmission line is disposed on a first dielectric material between the first port and the second port. L is an integer. M second transmission line layers are disposed in alternating layers with the L first transmission line layers to form a total of N transmission line layers within the structure. M and N are integers and N is greater than or equal to three. Each second transmission line layer includes a second transmission line substantially conforming to the predetermined geometric configuration. The second transmission line is disposed on a second dielectric material between the third port and the fourth port. Each second transmission line is disposed in a predetermined position relative to a corresponding first transmission line within the structure.

44 Claims, 11 Drawing Sheets

OTHER PUBLICATIONS

Hiroaki Tanaka, et al.; 2 GHz One Octave-band 90 Degree Hybrid Coupler Using Coupled Meander Line Optimized by 3-D FEM;1994 IEEE MTT-S Digest; pp. 903-906; 1994 IEEE; Nagaokakyo, Kyoto, Japan.

Seiichi Arai, et al.; A 900MHz 90 Degrees Hybrid for QPSK Modulator; 1991 IEEE MTT-S Digest; pp. 857-860; 1991 IEEE; Nagaokakyou-shi, Kyoto, Japan.

* cited by examiner (EVEN MODE)

(ODD MODE)

(ODD MODE)

(EVEN MODE)

(RELATED ART)

VERTICAL INTER-DIGITAL COUPLER

CROSS-REFERENCE TO RELATED APPLICATIONS

This is application is based on U.S. Provisional Patent Application 60/715,696 filed on Sep. 9, 2005, the content of which is relied upon and incorporated herein by reference in its entirety, and the benefit of priority under 35 U.S.C. § 119(e) is hereby claimed.

BACKGROUND OF THE INVENTION

1. Field of the Invention

The present invention relates generally to radio-frequency (RF) and/or microwave components, and particularly to RF and/or microwave coupled transmission line components.

2. Technical Background

Couplers are four-port passive devices that are commonly employed in radio-frequency (RF) and microwave circuits and systems. A coupler may be implemented by disposing two conductors in relative proximity to each other such that an RF signal propagating along a main conductor is coupled to a secondary conductor. The RF signal is directed into a first port connected to the main conductor and power is transmitted to a second port disposed at the distal end of the main conductor. An electromagnetic field is coupled to the secondary conductor and the coupled RF signal is directed into a third port connected to the secondary conductor. The secondary conductor is connected to a fourth port, commonly referred to as the isolation port. The term isolation port refers to the fact that, ideally, the RF signal is not available at this port.

Those of ordinary skill in the art will understand that directional couplers operate in accordance with the principles of superposition and constructive/destructive interference of RF waves. When coupling occurs, the RF signal directed into the input port of coupler is split into two RF signals. At the isolation port, the two incident signal and the coupled signal are substantially out of phase with each other and cancel each other. In practice, the cancellation is not perfect and a residual signal may be detected. The residual signal, of course, is a measure of the performance of the device. The output signal at the port directly connected to the main transmission line, and the coupled output port, are substantially in phase with each other and constructively interfere, i.e., the incident signal and the coupled signal reinforce each other. It should also be mentioned that the coupled output signal is typically out of phase with the output of the main transmission line.

In any event, coupled transmission lines are commonly used in RF/microwave circuits and systems to achieve a variety of functions. Many of the applications may only require a 3 dB coupler. For example, 3 dB couplers are often used in power splitter or power combiner applications. On the other hand, some applications may specify 5, 6, 10 and 20 dB coupling as typical numbers. In other words, less than half the incident power is directed to the coupled port. For example, a coupler may be employed to sample an RF output signal for use by a power level monitor. For example, the power level monitor circuit may require the coupled port to provide a signal −20 dB down from the incident signal. Another example of asymmetric coupling is an attenuator application. Other coupler applications include, but are not limited to, return loss cancellation and/or improvement, balanced amplification, and balun implementation. A balun may be implemented, for example, as a Marchand balun, an inverted balun, a Guanella balun or a Ruthroff balun. In each of the aforementioned balun implementations, coupling plays a major role in determining the impedance transformation ratio. One unique aspect of balun design relates to the use of an "overcoupled" coupler in certain implementations. An overcoupled coupler is a coupler with more than half the power going to the coupled port.

Those of ordinary skill in the art will understand that device weight and volume are important issues for most implementations. A variety of approaches have been used to miniaturize couplers, such as meandered lines, spiral lines, lumped realizations, ferrite transformers and electrical short couplers. One drawback associated with meandered couplers relates to the fact that they experience even/odd mode phase velocity imbalance as the lines are meandered tighter and tighter. Because of the constructive/destructive interference properties described above, this imbalance tends to negatively impact coupler performance.

Conventional spiral design configurations have drawbacks as well. The phase angle from one turn to the next of a spiral must be small relative to the wavelength or this implementation will also experience even/odd mode phase velocity imbalances. Lumped discrete component implementations are limited because they support a very narrow signal bandwidth. Additional discrete components must be employed to provide a coupler having a sufficiently wide bandwidth.

While ferrite transformer type couplers have very wide bandwidth, it is difficult to achieve arbitrary coupling values with ferrite couplers. Further, ferrite transformer couplers are inherently bulky and labor intensive.

So called "electrical short" couplers employ a combination of lumped elements and coupled transmission lines. The transmission lines are typically less than a quarter wavelength ($\lambda/4$). As the length of the transmission lines in the implementation are shortened, the bandwidth decreases to that of a fully lumped component implementation.

In other approaches, coaxial and waveguide couplers have been considered for coupler implementations. However, these implementations are rarely used in high volume applications because they are relatively expensive to manufacture. Further, these designs are difficult to integrate into RF systems. Thus, these coupler types are impractical.

The most commonly used couplers are referred to as the broadside coupler, edge coupler and the interdigital edge coupled design. The interdigital edge coupled transmission lines are commonly known as Lange couplers. To achieve high coupling in edge coupled transmission lines, the spacing between the coupled lines must be small. This spacing is determined by the capabilities of the photolithographic patterning process. Because of these manufacturing difficulties, it is difficult to produce 3 dB couplers using this method. In fact, coupling values do not typically exceed 10 dB.

Broadside couplers refer to the fact that the wide portion of the TEM transmission lines are disposed in the coupler facing each other. The broadside coupler includes two transmission lines separated by a homogeneous dielectric material. The transmission lines are interposed between two outer ground planes. Dielectric material is likewise disposed between each ground plane and the adjacent transmission line. This configuration supports TEM propagation and, unlike the microstrip interdigital couplers, even and odd mode phase velocities are equal. This results in relatively good bandwidth, directivity, and VSWR. Furthermore, broadside couplers may be used to implement 3 dB couplers. However, those of ordinary skill in the art will understand that transmission line spacing must be relatively small or the line widths must be wide, or both.

What is needed is a broadside coupler implementation that may be configured to achieve any desired coupling value without the constraints experienced by the conventional devices described above. Further, a coupler implementation is needed that may be implemented within in a desired form factor for a given performance specification.

SUMMARY OF THE INVENTION

The present invention addresses the needs described above. The present invention relates to a coupled transmission line structure that can be used as a coupler or as a building block in other structures/functions. The present invention is directed to three or more broadside coupled transmission lines that are vertically aligned. The benefits of this structure are the ability to produce very tight coupling and to realize very compact coupling structures in very small volume. The present invention requires a smaller area/volume than required by either a standard broadside coupler or an interdigital edge coupler to obtain the same functionality.

One aspect of the present invention is directed to a coupler structure that includes a first port, a second port, a third port, and a fourth port. L first transmission line layers are disposed in the structure. Each first transmission line layer includes a first transmission line conforming to a predetermined geometric configuration. The first transmission line is disposed on a first dielectric material between the first port and the second port. L is an integer. M second transmission line layers are disposed in alternating layers with the L first transmission line layers to form a total of N transmission line layers within the structure. M and N are integers and N is greater than or equal to three. Each second transmission line layer includes a second transmission line substantially conforming to the predetermined geometric configuration. The second transmission line is disposed on a second dielectric material between the third port and the fourth port. Each second transmission line is disposed in a predetermined position relative to a corresponding first transmission line within the structure.

In another aspect, the present invention is directed to a coupler structure that includes a first port, a second port, a third port, and a fourth port. L first transmission line layers are disposed in the structure. Each first transmission line layer includes a first transmission line conforming to a predetermined geometric configuration. The first transmission line is disposed on a first dielectric material between the first port and the second port. L is an integer. M second transmission line layers are disposed in alternating layers with the L first transmission line layers to form a total of N transmission line layers within the structure. M and N are integers and N is greater than or equal to three. Each second transmission line layer includes a second transmission line substantially conforming to the predetermined geometric configuration. The second transmission line is disposed on a second dielectric material between the third port and the fourth port. Each second transmission line is disposed in a predetermined position relative to a corresponding first transmission line within the structure. The cross-sectional area is a predetermined function of N, the predetermined geometrical configuration, and a selected coupling constant.

In yet another aspect, the present invention is directed to method for making a coupler. The method includes: (a) providing a first transmission line layer, the first transmission line layer including a first transmission line disposed on a first dielectric material and conforming to a predetermined geometric configuration; (b) disposing a second transmission line layer on the first transmission line layer, second transmission line layer including a second transmission line being vertically aligned to the first transmission line and substantially conforming to the predetermined geometric configuration, the second transmission line being disposed on a second dielectric material; (c) bonding the first transmission line layer and the second transmission line layer; (d) repeating steps (a)-(c) to form a laminate structure comprising N alternating layers of L first transmission line layers and M second transmission line layers, L, M, and N being integers, wherein N is greater than or equal to three; (e) coupling a first end of the L first transmission lines to a first port and a second end of the L first transmission lines to a second port; and (f) coupling a first end of the M second transmission lines to a third port and a second end of the M second transmission lines to a fourth port.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION

Figure 1:
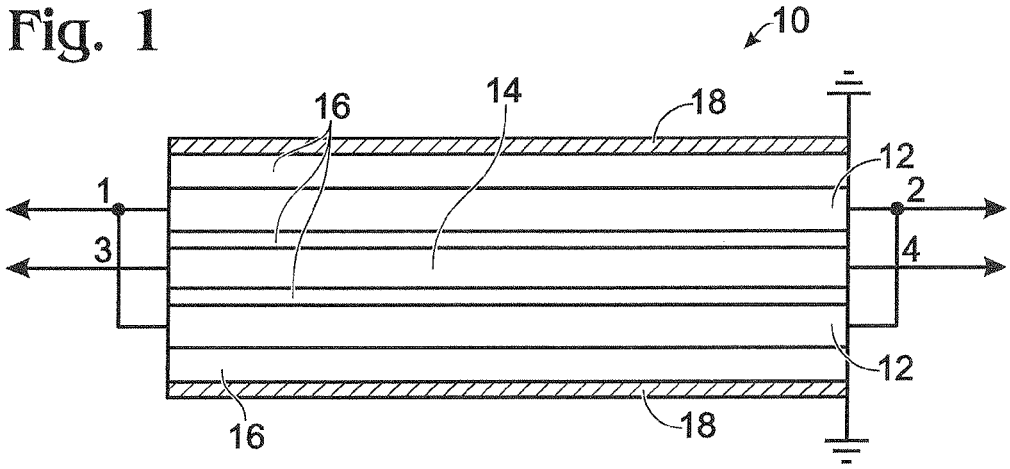
FIG. 1 is a schematic diagram of a vertical interdigital coupler in accordance with one embodiment of the present invention.

Reference will now be made in detail to the present embodiments of the invention, examples of which are illustrated in the accompanying drawings. Wherever possible, the same reference numbers will be used throughout the drawings to refer to the same or like parts. An exemplary embodiment of the vertical interdigital coupler of the present invention is shown in FIG. 1, and is designated generally throughout by reference numeral 10.

As embodied herein, and depicted in FIG. 1, a schematic diagram of a cross-sectional portion of a vertical interdigital coupler in accordance with a embodiment of the present invention is disclosed. The coupler is a four port device that includes port 1, port 2, port 3, and port 4. In this embodiment, the vertical interdigital coupler includes three coupled transmission lines, i.e., transmission line 14 is interposed between two transmission lines 12. Each transmission lines 12 is disposed on a dielectric substrate 16 and coupled between port 1 and port 2 to form a transmission line layer. The transmission lines 14 are also disposed on a dielectric substrate 16 to form an adjacent transmission line layer. Transmission lines 14 are coupled between port 3 and port 4.

In general, transmission line layers 14 are disposed in alternating layers with transmission line layers 12 to form a total of N transmission line layers. Transmission lines 12 and transmission lines 14 are disposed in a predetermined vertical position relative to each other. In one embodiment, transmission lines 12 are vertically aligned with transmission lines 14 to effect maximum coupling. In other embodiment, transmission lines 14 are vertically offset from transmission lines 12 to obtain a different degree of coupling. In other words, the vertical geometric configuration may be adjusted to obtain a predetermined coupling constant. In accordance with the present invention, N is an integer value that is greater than or equal to three (3). N may be selected for a variety of reasons including coupling value, form factor considerations and etc. The alternating layers of transmission line layers 12 and transmission line layers 14 are typically disposed between a pair of ground plates 18. In certain embodiment, however, the ground plates 18 are unnecessary. Each second transmission line is disposed in a predetermined position relative to a corresponding first transmission line within the structure.

Figure 2:
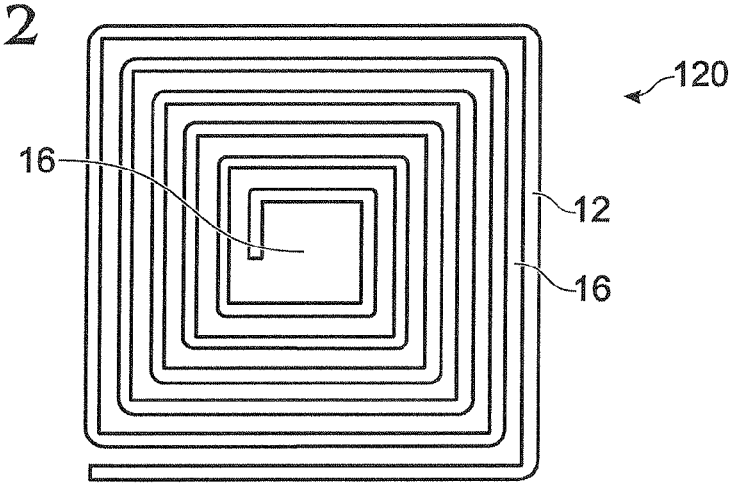
FIG. 2 is a plan view of a transmission line layer of a vertical interdigital coupler in accordance with the present invention.

Referring to FIG. 2, a plan view of a transmission line layer 12 is shown. FIG. 2 is equally applicable to line 14. As noted above, transmission lines 12, 14 are configured to conform to a predetermined geometric configuration. In this case, transmission line 12 is disposed in a folded square geometry. The length of transmission line 12 is approximately 68 mm. The geometric configuration, therefore, refers to the shape of the transmission line in plan view, the width of the conductors, the thickness of the conductors, the thickness of the dielectric, and all the various spacing dimensions. It will be apparent to those of ordinary skill in the pertinent art that modifications and variations can be made to predetermined geometric configuration of the present invention depending on the desired coupling and the specified volume/dimensional form factor requirements. In the illustrated example, transmission line 12 is disposed on substrate 16 in a folded square configuration. On the other hand, those of ordinary skill in the art will understand that the geometric configuration may be any suitable shape, such as linear, rectangular, non-linear, spiral or circular, and etc. The geometric pattern may include meandered line segments and other such geometries.

Figure 3A:
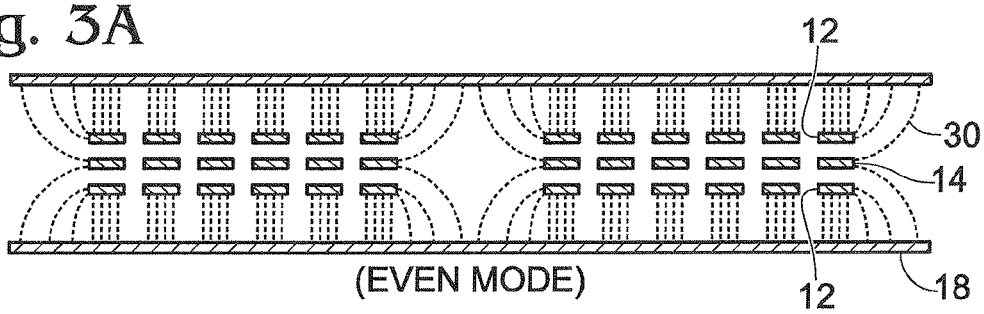
FIG. 3A-3B are diagrammatic depictions of the even mode and odd mode coupling field lines for the coupler depicted in FIG. 2.

FIG. 3A is a diagrammatic depiction of even mode coupling field lines for the coupler depicted in FIG. 2. As those of ordinary skill in the art will appreciate, even mode coupling refers to the scenario wherein transmission line 12 and transmission line 14 are at the same electrical potential. By definition, there is no coupling between transmission lines 12 and the transmission line 14 sandwiched therebetween. However, an electric field is established between transmission lines 12, 14 and the ground plates 18.

Figure 3B:
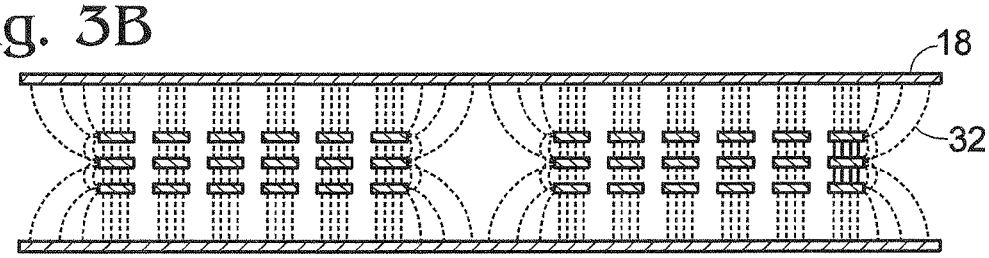

FIG. 3B is a diagram of the odd mode field lines. In the odd-mode, transmission lines 12 and transmission line 14 are at different potentials. Accordingly, an electric field is generated between transmission lines 12 and transmission line 14. FIGS. 3A-3B further illustrate that the arrangements depicted herein may be approximated as a parallel plate capacitor configuration. Thus, the capacitance is proportional to the area of the transmission line broad side, i.e., the length and width of the coupled broadside.

FIG. 3B is noteworthy because illustrates the improved coupling characteristics of the present invention relative to conventional devices. Note that transmission line 14 is coupled to transmission lines 12 from both sides of the transmission line.

The features and benefits of the present invention are more readily illustrated by comparing the three-layer vertical interdigital broad side coupler (FIGS. 1-3) with commonly used conventional couplers. In particular, FIGS. 4A-4D provide various views of a conventional broadside coupler 410. FIGS. 5A-5D, on the other hand, depicts the features of a conventional interdigital edge coupled device. Each of these conventional devices are taken in turn.

Figure 4A:
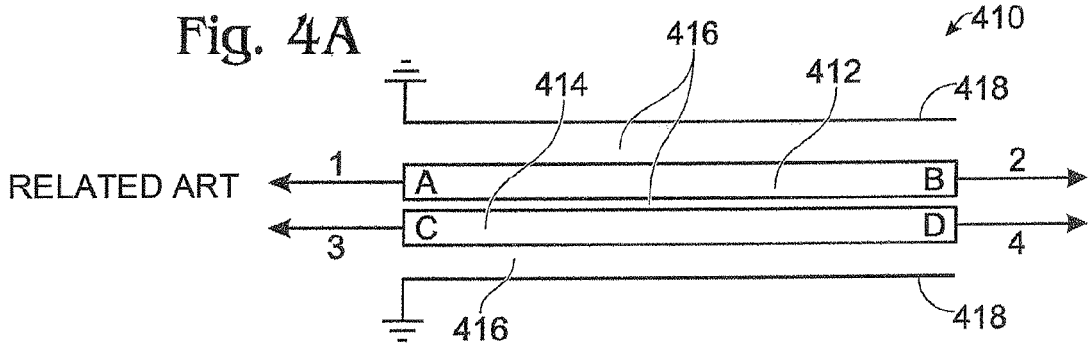
FIG. 4A-4D are various views and depictions of a conventional broadside coupler.

Referring to FIG. 4A, a cross-sectional schematic view of a conventional broadside coupler 410 is shown. Coupler 410 includes main transmission line 412 coupled between port 1 and port 2. Secondary transmission line 414 is disposed in coupled proximity to line 412 and coupled between port 3 and port 4.

Figure 4B:
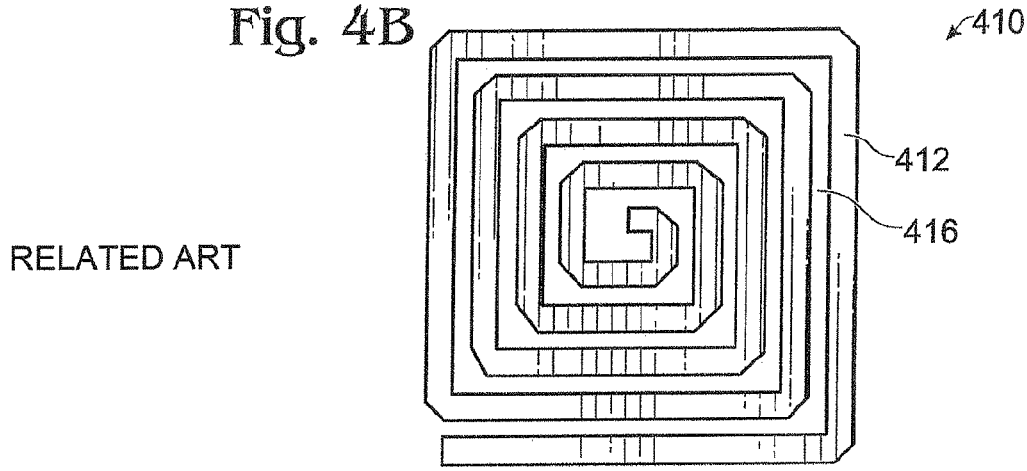

Referring to FIG. 4B, the conventional broadside coupler is disposed in the same "footprint", i.e., the identical surface area, as depicted in FIG. 2. While the width of transmission line 412 is marginally wider than the width of transmission line 12 in FIG. 2, it is 18 mm smaller, i.e., it is approximately 50 mm.

Figure 4C:
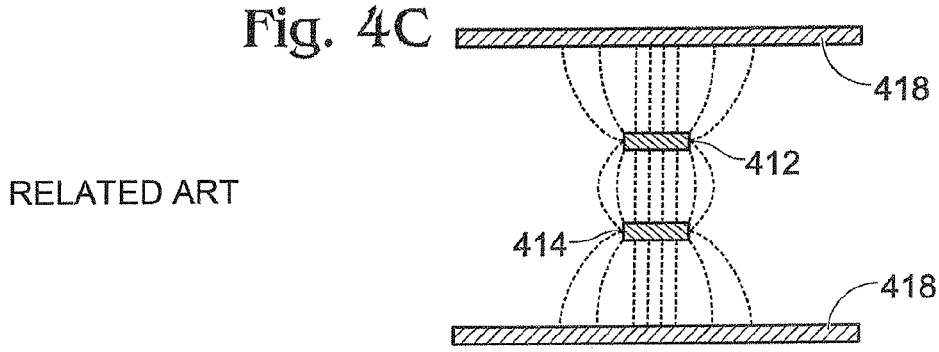
Figure 4D:
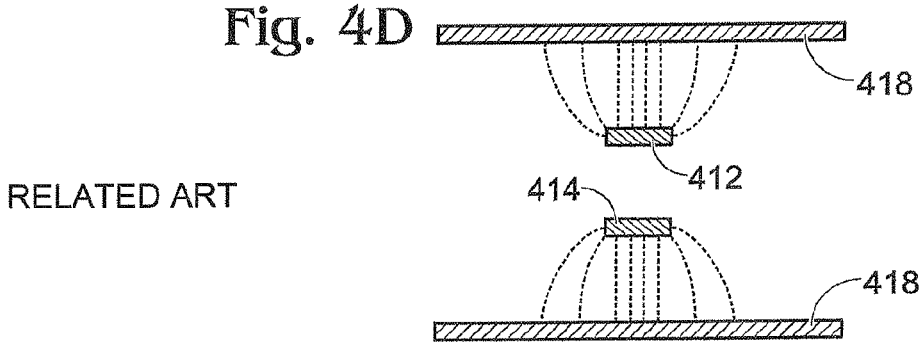

The odd-mode coupling characteristics of the conventional broadside coupler are shown in FIG. 4C. Even-mode coupling is depicted in FIG. 4D. The interdigital broadside coupler of the present invention (N=3 lines) realizes the same coupling value as the standard broadside coupler (2 transmission lines). The present invention has more line length per area, which equates to a more compact design for the same length. For a specific equivalent coupling value the even and odd mode impedances must have a specific relationship given by:

$$k = \frac{Z_{0e} - Z_{0o}}{Z_{0e} + Z_{0o}} \Leftrightarrow Z_{0e} = Z_{0o}\frac{1+k}{1-k} \tag{1}$$

The same odd mode impedance is achieved by the present invention with a narrower line width relative to the conventional device. And the even-mode impedance is higher. As such, the present invention yields a stripline height reduction and miniaturization (volume reduction) for an equivalent coupling value.

Of course, even-mode impedance may also be adjusted by changing the dielectric material since impedance is a function of the dielectric permittivity. Materials having a higher dielectric constant lower the even-mode impedance. Accordingly, altering the dielectric will only result in a reduction in the X-Y plane, i.e., in the horizontal plane. On the other hand, a volume reduction will not be realized using this approach.

Since coupling is mostly a function of line width and dielectric spacing, one may be tempted to employ thinner dielectric substrates between the transmission lines 512, 514 in the conventional broadside coupler (FIGS. 4*a*-4D). However, this approach is not feasible because dielectric materials having a width of less than 1 mil are scarce. Even when such materials may be obtained, the dielectric breakdown voltage of the material becomes an issue. In particular, the dielectric must have an excellent dielectric breakdown voltage characteristics to be useful in a commercial product. Even if both of the aforementioned problems are solved, new handling methods would have to be devised to enable processing of such thin materials.

Figure 5A:
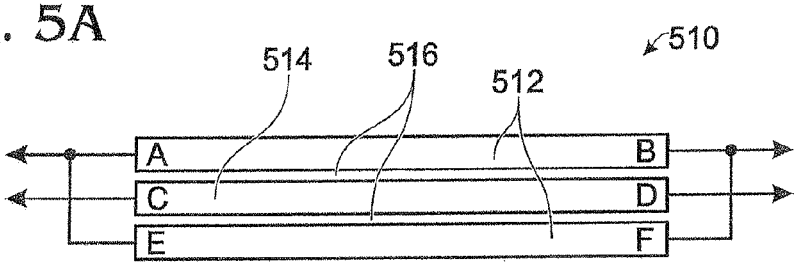
Fig. 5A RELATED ART
FIG. 5A-5D are various views and depictions of a conventional interdigital edge coupled device.
Figure 5B:
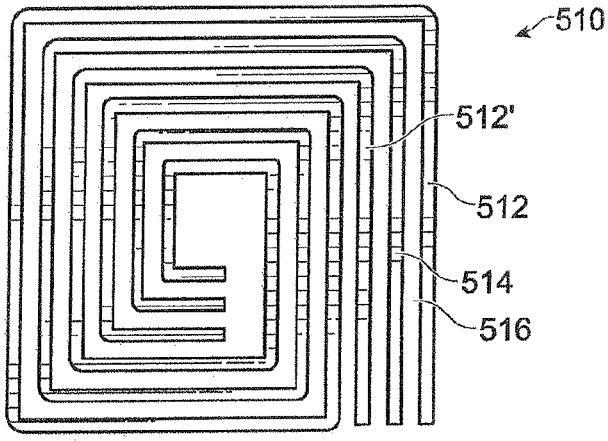
Fig. 5B RELATED ART
Figure 5C:
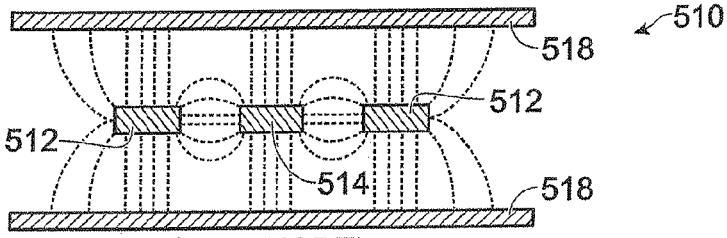
Fig. 5C RELATED ART
Figure 5D:
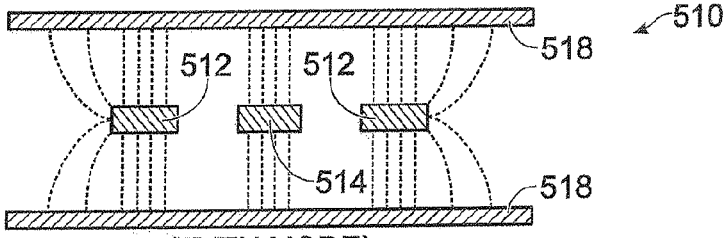
Fig. 5D RELATED ART

Referring to FIG. 5A, a plan schematic view of a conventional interdigital edge coupler is shown. The edge couple design includes transmission line 514 interposed between transmission lines 512. FIG. 5B shows the coupler configuration in plan view. The footprint for FIG. 5B is the same as the footprint for FIG. 2 and FIG. 4B. In this case, the exterior transmission line 512 is 27 mm in length, the middle line 514 is 22.5 mm, whereas the interior line 512' is only 18 mm. Unlike the interdigital edge coupler 510, the individual lines of the interdigital broadside coupler 10 of the present invention are all the same length. Accordingly, the present invention avoids losses incurred by combining unequal phases. Note also that the conventional edge coupler design has larger phase differences from one turn to the next. The phase differences are due to disposing three (3) transmission lines in parallel. Thus, the conventional coupler 510 will experience phase velocity issues at lower number of turns than the present invention. Accordingly, the present invention represents superior performance relative to the conventional devices currently available.

Figure 6:
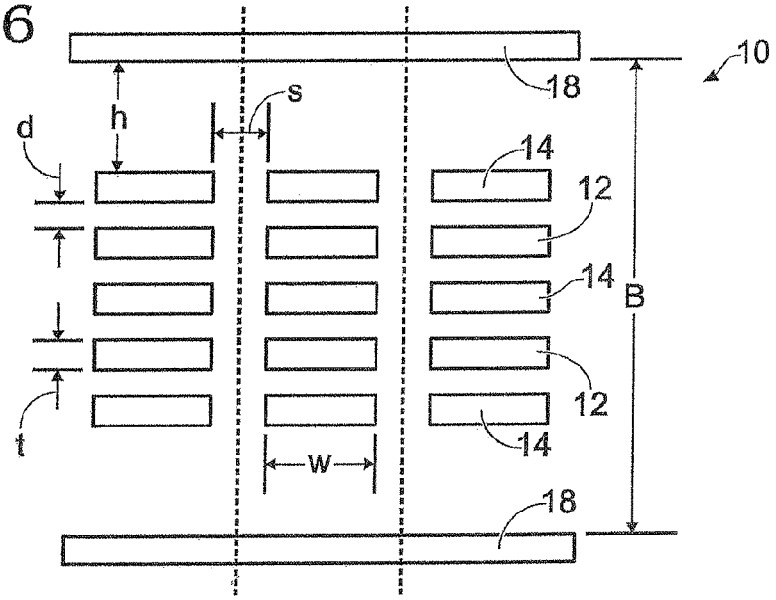
FIG. 6 is a diagram illustrating the coupler cross-sectional area in accordance with the present invention.

FIG. 6 is a diagram showing coupler cross-sectional design considerations in accordance with the present invention. As noted previously, the vertical interdigital broadside coupler 10 may be miniaturized and engineered to be disposed in a physical form factor having predetermined dimensional specifications. In the example provided, there are four vertically broadside coupled transmission lines 12, 14, i.e., N=4. Dimension h is the vertical distance between each pair of broadside coupled transmission lines 12, 14. Dimension h is the vertical distance from each outermost conductor 14 to the closest ground plane 18 (if present). Dimension t is the vertical height of each conductor 12, 14. Dimension s is the horizontal spacing between adjacent segments in a given transmission line conductor. Dimension w is the width of each conductor, i.e., the dimension in the horizontal plane of FIG. 6. Finally, m is the ratio between conducting and non-conducting material in the horizontal direction, wherein:

$$m \approx \frac{w}{w+s} \tag{2}$$

The total ground plane spacing of the stripline structure, not including conductor thickness is:

$$b_N = 2h + (N-1)d \tag{3}$$

The total ground plane spacing of the stripline structure including the conductor thickness is:

$$B_N = 2h + (N-1)d + Ntm \tag{4}$$

The cross sectional area occupied by a coupled section is therefore:

$$A_N = B_N(s+w) = (s+w)(2h + (N-1)s + Ntm) \tag{5}$$

Equation (5) is an approximation that assumes that the structure has an electrical wall interposed between each vertical conductor group. This approximation is reasonable for tightly spiraled structures with X-Y dimension much smaller than one quarter wavelength (λ/4). Thus, the capacitances can be approximated to that of parallel plate capacitance:

$$C_P = \varepsilon_0 \varepsilon_r \frac{lw}{d_{CP}} \tag{6}$$

The dimension l is the length of the transmission lines and $d_{CP}$ is the distance between the plates.

$$\text{If } C_x = \varepsilon_0 \varepsilon_r lw, \text{ [Fm]} = 8.854 \varepsilon_r lw, \text{ [pFm]}, \tag{7}$$

$$\text{then; } C_P = \frac{C_x}{d_{cp}}. \tag{8}$$

$C_x$ is employed in the even and odd mode capacitance equations derived herein. Those of ordinary skill in the art will understand that the constants $\in_0$ and $\in_r$ in equation (7) refer to the permittivity of the dielectric material. Permittivity is a measure of a dielectric material's response to an applied electric field. In particular, if the permittivity of a first dielectric material is larger than the permittivity of a second dielectric material, the first material will store a greater charge for a given applied electric field. As equation (7) suggests, permittivity is proportional to capacitance. Thus, the first dielectric material will have a greater capacitance. Note also that $\in_0$, the permittivity of free space is $8.8541878176 \times 10^{-12}$ farads per meter (F/m). Hence, [pFm] is used to denote "pico Farads per meter" in equation (7).

Figure 7A:
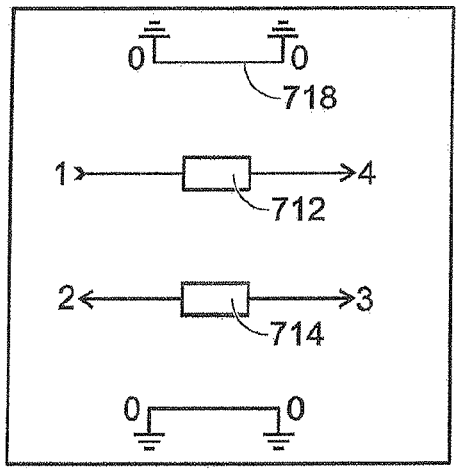
Fig. 7A (RELATED ART)
FIGS. 7A-7C are schematic diagrams illustrating conventional broadside coupler design considerations.
Figure 7B:
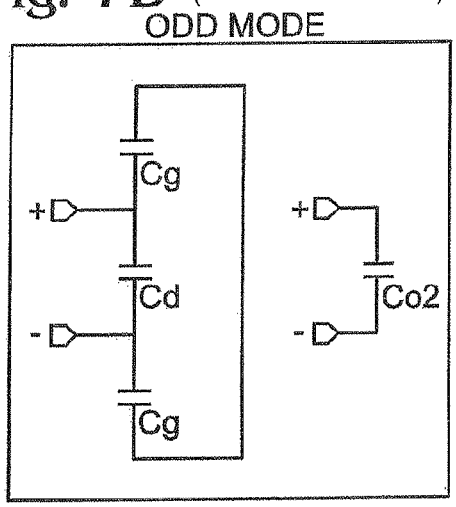
Fig. 7B (RELATED ART)
Figure 7C:
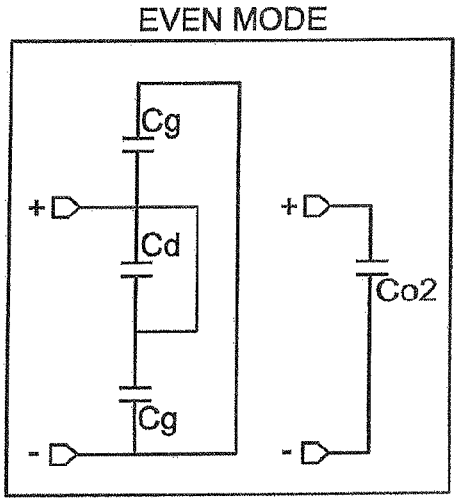

FIGS. 7A-7C are used in the derivation of the even-mode and odd-mode capacitances for the conventional broadside coupler design. Note that FIG. 7A is a recapitulation of FIG. 4A. FIG. 7B is a schematic showing equivalent odd-mode capacitances for the conventional broadside coupler design. FIG. 7C is a schematic showing equivalent even-mode capacitances for the conventional design. The fundamental parallel plate capacitances are as follows:

$$C_g = \frac{C_x}{h}; \text{ and} \tag{9}$$

$$C_d = \frac{C_x}{d}. \tag{10}$$

The resultant odd and even mode capacitances are as follows:

$$C_{o2} = C_d + \frac{C_g}{2} = \frac{C_x}{d} + \frac{C_x}{2h} = C_x\left(\frac{1}{d} + \frac{1}{2h}\right) \tag{11}$$

-continued $$C_{ec} = 2C_g = \frac{2C_x}{h} \tag{12}$$

Figure 8A:
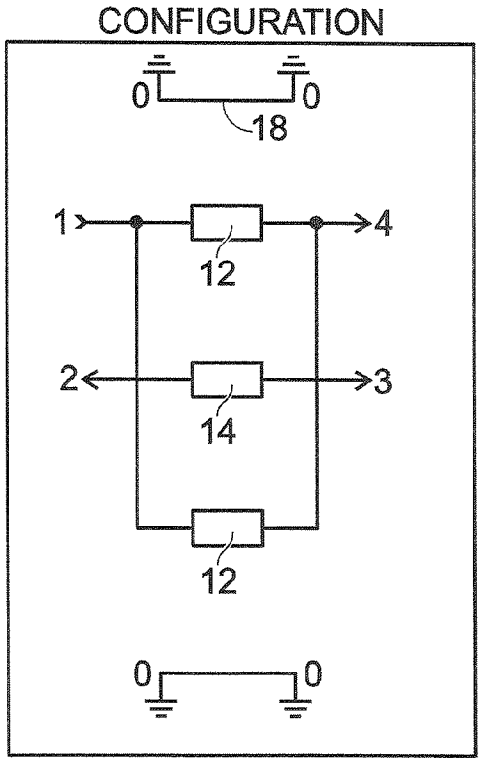
FIGS. 8A-8C are schematic diagrams illustrating vertical interdigital coupler design considerations in accordance with a three-layer embodiment of the present invention.
Figure 8B:
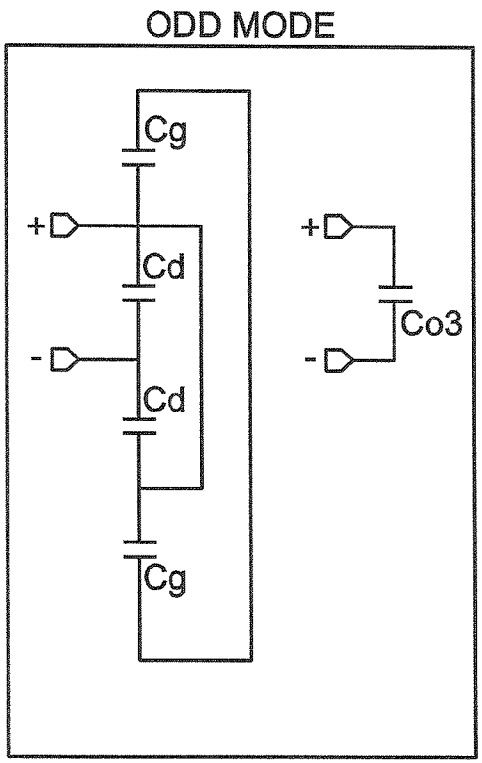
Figure 8C:
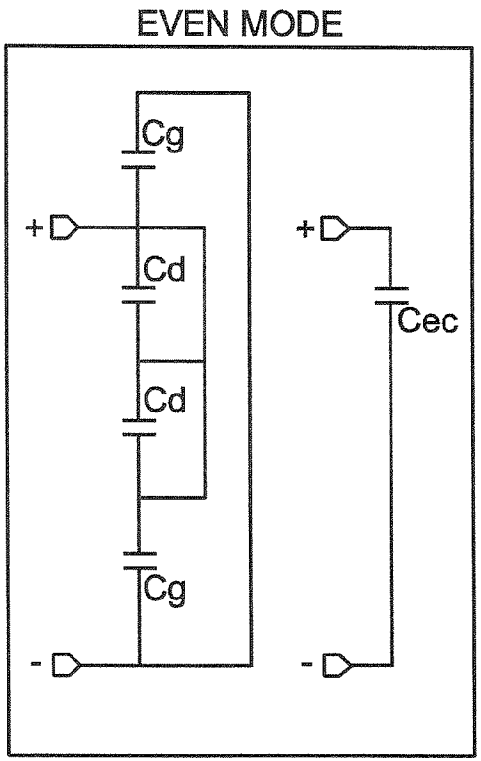

FIGS. 8A-8C are schematic diagrams illustrating vertical interdigital coupler design considerations in accordance with a three-layer embodiment of the present invention. FIG. 8B is a schematic showing equivalent odd-mode capacitances for the three layer coupler design of the present invention. FIG. 8C is a schematic showing the equivalent even-mode capacitances.

$$C_{o3} = 2C_d = \frac{2C_x}{d} \tag{13}$$

Note that the odd-mode capacitance does not depend on the strip line height. This implies that the stripline ground planes may be removed without any adverse consequences (relative to the odd mode). In other words, this design is an approximation of a coax cable. Also of note is that the even-mode capacitance is identical to the conventional 2-layer broadside coupler. In fact, the even-mode capacitance does not depend on the value of N.

Figure 9A:
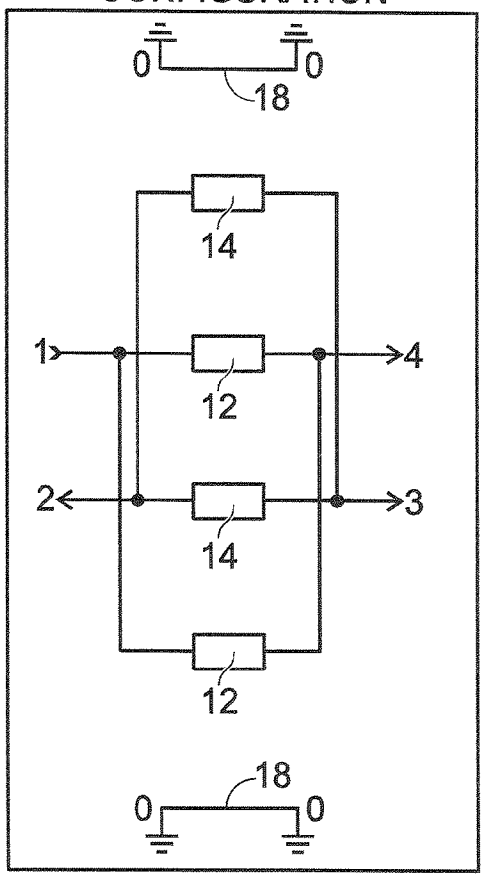
FIGS. 9A-9C are schematic diagrams illustrating vertical interdigital coupler design considerations in accordance with a four-layer embodiment of the present invention.
Figure 9B:
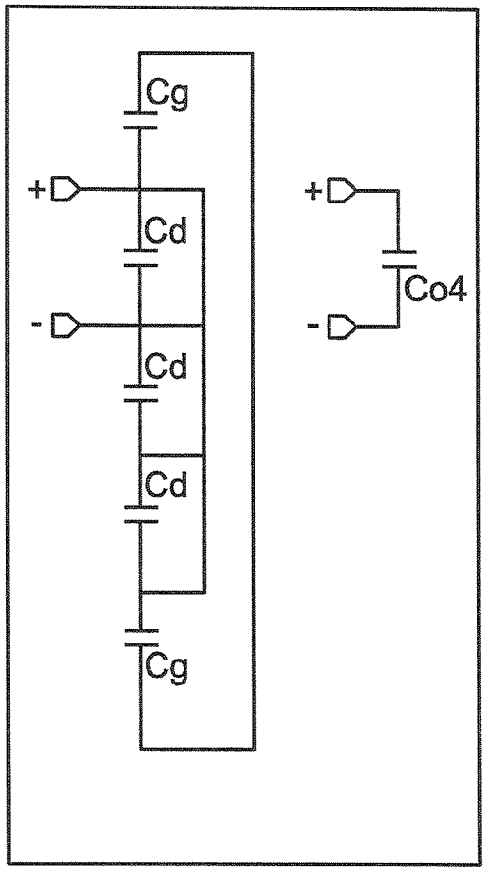

FIG. 9A is a schematic diagram showing a four-layer vertical interdigital coupler in accordance with the present invention. The schematic is self-explanatory. It includes two transmission lines 12 interleaved with two transmission lines 14. The four layers are interposed between ground plates 18. FIG. 9B is a schematic showing equivalent odd-mode capacitances for the four layer embodiment.

$$C_{o4} = 3C_d + \frac{C_g}{2} = C_x\left(\frac{3}{d} + \frac{1}{2h}\right) \tag{14}$$

Again, the even mode value is identical to the conventional 2-layer broadside coupler.

Figure 10A:
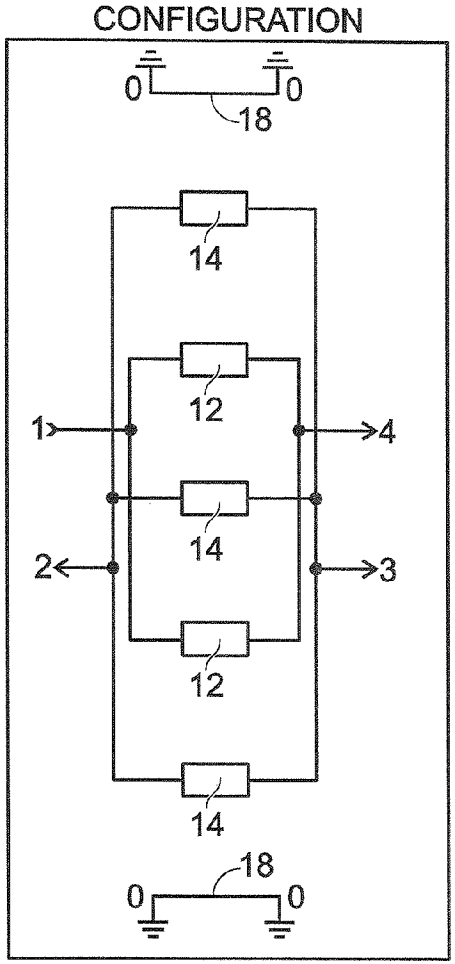
FIGS. 10A-10C are schematic diagrams illustrating vertical interdigital coupler design considerations in accordance with a five-layer embodiment of the present invention.
Figure 10B:
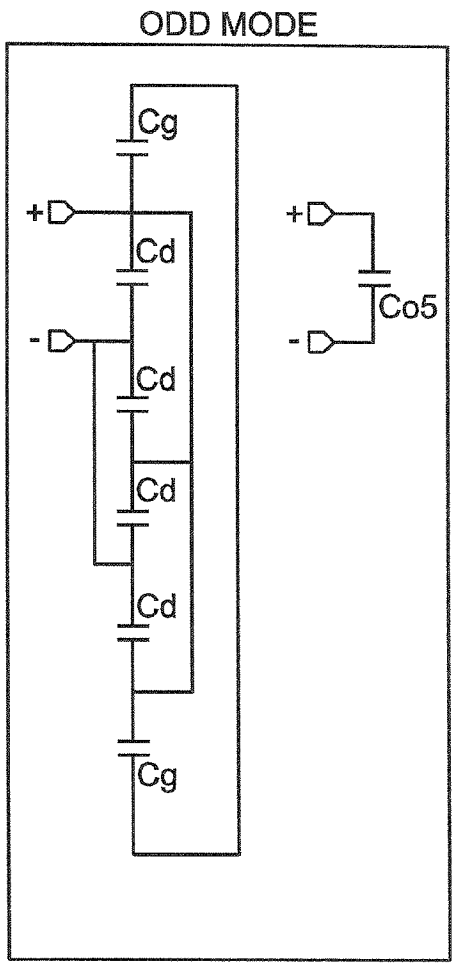
Figure 10C:
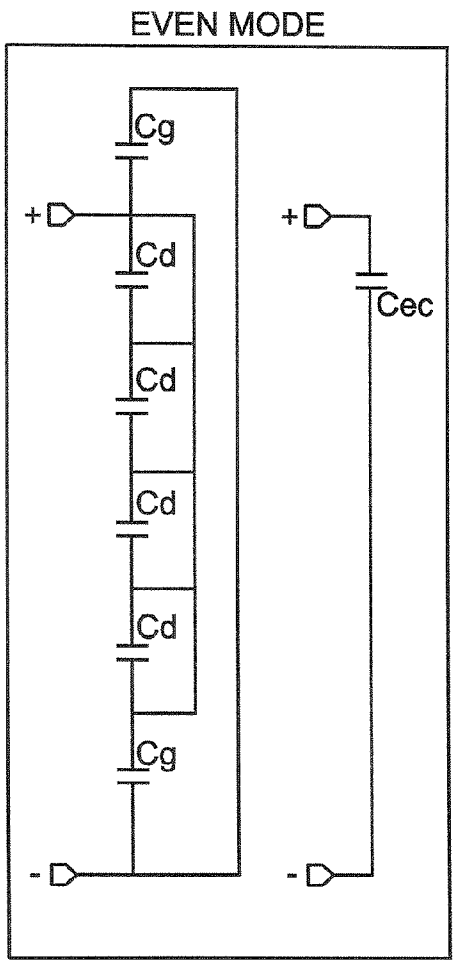

FIGS. 10A-10C are a schematic diagrams illustrating vertical interdigital coupler having five-layers. Again, the layout shown in FIG. 10A is self-explanatory. Coupler 10 includes two "main" transmission lines 12 interleaved with three secondary transmission lines 14. The four layers are interposed between ground plates 18. In FIG. 10B, the odd-mode capacitance is illustrated. For five conductors:

$$C_{o5} = 4C_d = \frac{4C_x}{d} \tag{15}$$

The odd-mode capacitance may given as a function of N.

$$C_{oN} = \begin{Bmatrix} NC_d, & N = \text{odd} \\ NC_d + \frac{C_g}{2}, & N = \text{even} \end{Bmatrix} = \begin{Bmatrix} \frac{NC_x}{d}, & N = \text{odd} \\ C_x\left(\frac{N}{d} + \frac{1}{2h}\right), & N = \text{even} \end{Bmatrix} \tag{16}$$

As noted above, the even-mode capacitances are constant.

$$C_e = 2C_g = \frac{2C_x}{h} \tag{17}$$

In view of the above derivations, a general formula for the capacitances may be expressed as:

$$C_{xN} = \begin{Bmatrix} \frac{dC_o}{N}, & N = \text{odd} \\ \frac{C_o}{\left(\frac{N}{d} + \frac{1}{2h}\right)}, & N = \text{even} \end{Bmatrix} = \begin{Bmatrix} \frac{dC_o}{N}, & N = \text{odd} \\ \frac{2C_o dh}{2hN + d}, & N = \text{even} \end{Bmatrix} \tag{18}$$

$$C_x = \frac{hC_e}{2} \tag{19}$$

However, since $C_e$, depends on $C_x$ it would be more useful to describe the functions for constant coupling. Coupling may be defined as follows for a TEM structure. As noted in equation (1)

$$k = \frac{Z_e - Z_o}{Z_e + Z_o},$$

where each involved impedance can be described as $$Z = \frac{\sqrt{\mu\varepsilon}}{C} = \frac{\sqrt{\mu_r\varepsilon_r}}{cC},$$

or alternatively as $$Z = \frac{L}{\sqrt{\mu\varepsilon}}, Z = \sqrt{\frac{L}{C}}$$

If we assume unity frequency, a homogeneous dielectric, and only consider the capacitances, then:

$$k = \frac{Z_e - Z_o}{Z_e + Z_o} = \frac{\frac{\sqrt{\mu_r\varepsilon_r}}{cC_e} - \frac{\sqrt{\mu_r\varepsilon_r}}{cC_o}}{\frac{\sqrt{\mu_r\varepsilon_r}}{cC_e} + \frac{\sqrt{\mu_r\varepsilon_r}}{cC_o}} = \frac{C_o - C_e}{C_o + C_e} \Leftrightarrow C_e = C_o\frac{1-k}{1+k} \Leftrightarrow C_o = C_e\frac{1+k}{1-k} \tag{20}$$

Thus, inserting equation (18) and equation (19) into equation (20), the coupling value k may be put in terms of the cross-sectional geometry of the coupler.

Figure 11:
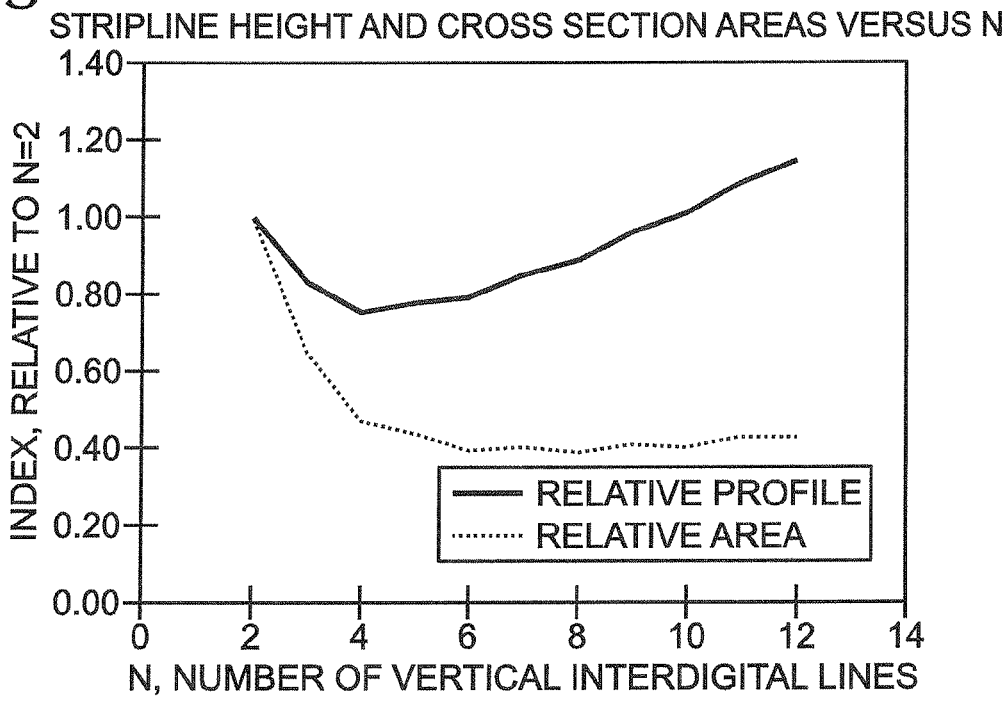
FIG. 11 is a chart comparing cross-sectional area of a conventional broadside coupler to cross-sectional areas of the present invention for multiple values of N.

Referring to FIG. 11, a chart comparing the cross-sectional area of a conventional broadside coupler, i.e. N=2, to the cross-sectional areas of the present invention (N≧3) are shown. FIG. 11 is a graphical depiction of the data shown in Table 1 below. In this example, the total stripline height and the cross section area of the present invention is compared to a conventional broadside coupler by keeping even and odd mode capacitance constant. For a typical 3 dB coupler, k=0.707 and hence, $C_o \approx 0.048$. The comparison provided in Table 1 employs typical dimensional values.

TABLE 1

Interdigital coupled lines vs. conventional broadside coupler

| k = 0.707 | | | t/d = 0.500 | | | s/d = 1.000 | | | | |
|---|---|---|---|---|---|---|---|---|---|---|
| N | Cx | Cx/Cx2 | h/d | t/d | w/d | m | BN | Relative Profile | AN | Relative Area |
| 2 | 0.0231 | 1.000 | 5.60 | 0.5 | 3.00 | 0.75 | 12.95 | 1.00 | 51.80 | 1.00 |
| 3 | 0.0161 | 0.696 | 3.90 | 0.5 | 2.09 | 0.68 | 10.81 | 0.84 | 33.41 | 0.64 |
| 4 | 0.0116 | 0.500 | 2.80 | 0.5 | 1.50 | 0.60 | 9.80 | 0.76 | 24.50 | 0.47 |
| 5 | 0.0097 | 0.418 | 2.34 | 0.5 | 1.25 | 0.56 | 10.07 | 0.78 | 22.69 | 0.44 |
| 6 | 0.0077 | 0.333 | 1.87 | 0.5 | 1.00 | 0.50 | 10.23 | 0.79 | 20.47 | 0.40 |
| 7 | 0.0069 | 0.298 | 1.67 | 0.5 | 0.90 | 0.47 | 11.00 | 0.85 | 20.84 | 0.40 |
| 8 | 0.0058 | 0.250 | 1.40 | 0.5 | 0.75 | 0.43 | 11.51 | 0.89 | 20.15 | 0.39 |
| 9 | 0.0054 | 0.232 | 1.30 | 0.5 | 0.70 | 0.41 | 12.45 | 0.96 | 21.12 | 0.41 |
| 10 | 0.0046 | 0.200 | 1.12 | 0.5 | 0.60 | 0.38 | 13.12 | 1.01 | 20.99 | 0.41 |
| 11 | 0.0044 | 0.190 | 1.06 | 0.5 | 0.57 | 0.36 | 14.12 | 1.09 | 22.17 | 0.43 |
| 12 | 0.0039 | 0.167 | 0.93 | 0.5 | 0.50 | 0.33 | 14.87 | 1.15 | 22.30 | 0.43 |

The vertical axis in FIG. 11 is normalized to a conventional broadside coupler, i.e., an index value of 1.00 refers to the cross-sectional area of the conventional broadside coupler with all things being equal (coupling value, dielectric material, and etc.). It is quite interesting to note that the relative cross sectional area decreases markedly as N increases. Relative stripline profile is also lower for values of N below ten (10). However, the relative area curve and the relative profile curve have much different minima.

Those of ordinary skill in the art will understand that Table 1 and FIG. 11 are based on certain predetermined dimensional properties and coupling values. Accordingly, N, the geometric configuration of the transmission lines 12, 14, dielectric materials, conductor materials, and the dimensional relationships may be varied to obtain different minima values. Of course, these variables may be altered to meet form factor requirements as well.

Figure 12:
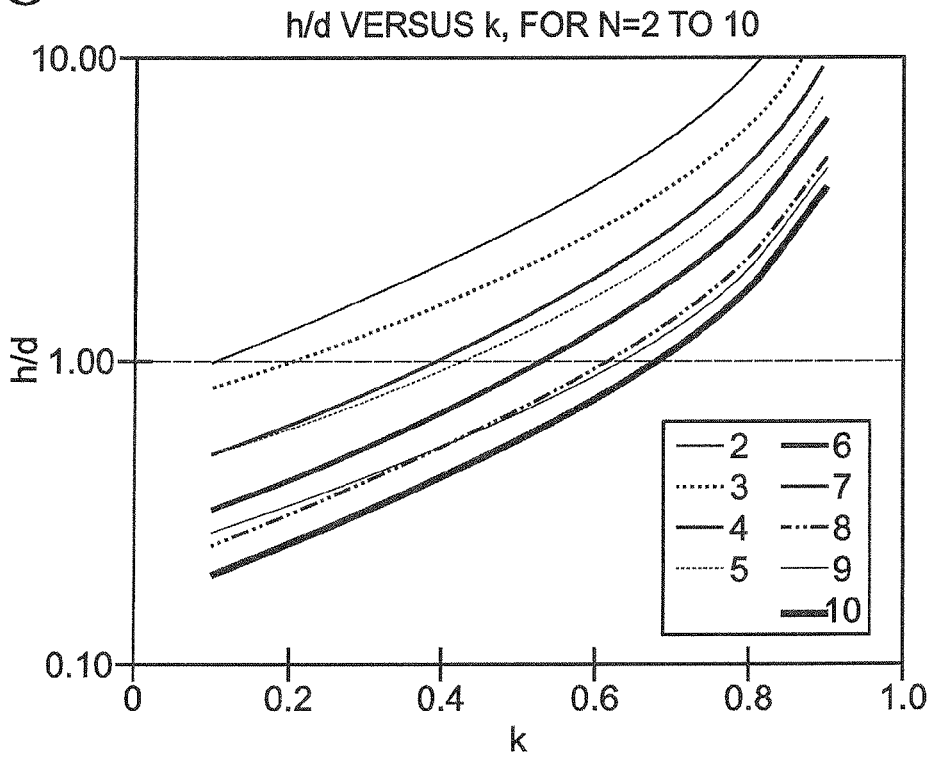
FIG. 12 is a chart comparing selected coupling constants to one measure of device geometry for multiple values of N.

Referring to FIG. 12, it may be useful to compare coupling values k with h/d for various values of N. The relationships provided in equation (18) and equation (19), one may be used to solve for the ratio h/d:

$$\left\{\begin{array}{ll} \frac{hC_e}{2} = \frac{dC_o}{N}, & N = \text{odd} \\ \frac{hC_e}{2} = \frac{C_o}{\left(\frac{N}{d} + \frac{1}{2h}\right)}, & N = \text{even} \end{array}\right\}; \tag{21}$$

-continued $$C_o = C_e \frac{1+k}{1-k}; \tag{22}$$

$$\left\{\begin{array}{ll} C_o \frac{h}{2}\left(\frac{1-k}{1+k}\right) = \frac{dC_o}{N}, & N = \text{odd} \\ C_o \frac{h}{2}\left(\frac{1-k}{1+k}\right) = \frac{C_o}{\left(\frac{N}{d} + \frac{1}{2h}\right)}, & N = \text{even} \end{array}\right\} \Leftrightarrow \tag{23}$$

$$\left\{\begin{array}{ll} \frac{h}{d} = \frac{2}{N}\left(\frac{1+k}{1-k}\right), & N = \text{odd} \\ \frac{(2hN+d)}{4d} = \left(\frac{1+k}{1-k}\right), & N = \text{even} \end{array}\right\} \Leftrightarrow$$

$$\left\{\begin{array}{ll} \frac{h}{d} = \frac{2}{N}\left(\frac{1+k}{1-k}\right), & N = \text{odd} \\ \frac{(2hN+d)}{4d} = \left(\frac{1+k}{1-k}\right) \Leftrightarrow \frac{h}{d} = \frac{2}{N}\left(\left(\frac{1+k}{1-k}\right) - \frac{1}{4}\right), & N = \text{even} \end{array}\right\}$$

Table 2 provides the numerical data required to generate the chart in FIG. 12.

TABLE 2

Common coupling values and related h/d values vs. N

| | h/d table | | | | | | | | | |
|---|---|---|---|---|---|---|---|---|---|---|
| dB | k | 2 | 3 | 4 | 5 | 6 | 7 | 8 | 9 | 10 |
| -3 | 0.71 | 5.60 | 3.90 | 2.80 | 2.34 | 1.87 | 1.67 | 1.40 | 1.30 | 1.12 |
| -5 | 0.56 | 3.32 | 2.38 | 1.66 | 1.43 | 1.11 | 1.02 | 0.83 | 0.79 | 0.66 |
| -6 | 0.50 | 2.76 | 2.01 | 1.38 | 1.20 | 0.92 | 0.86 | 0.69 | 0.67 | 0.55 |
| -10 | 0.32 | 1.67 | 1.28 | 0.84 | 0.77 | 0.56 | 0.55 | 0.42 | 0.43 | 0.33 |
| -20 | 0.10 | 0.97 | 0.81 | 0.49 | 0.49 | 0.32 | 0.35 | 0.24 | 0.27 | 0.19 |

Note again that the parallel plate capacitor model is an approximation. In practice the h/d numbers may multiplied by a constant value in accordance with the plan view geometric configuration (e.g., see FIG. 2). For example, if the geometric configuration is a tightly wound spiral, h/d should be multiplied by approximately 0.7. While Table 2 provides values for N up to ten (10), the present invention should not be construed as being limited to that number. In certain embodiments, N may equal twenty (20) or greater, to achieve the desired performance. Those of ordinary skill in the art will also understand that the present invention should not be construed as being limited to the coupling values provided in Table 2; 3, 5, 6, 10, and 20 dB couplers are merely typical coupling values.

As noted in the Background Section, coupling values greater than 3 dB refer to coupler devices wherein less than half of the incident signal is directed out of the coupled port. In some cases, it is desirable to have a coupling value less than 3 dB, i.e., wherein a majority of the incident signal is directed out of the coupled port. Further, some implementations may require a zero (0) dB coupler, i.e., wherein all of the incident signal, less insertion losses of course, is directed out of the coupled port. Accordingly, in addition to the discrete coupling values provided in Table 2, coupler devices having any coupling coefficient greater than or equal to zero (0) dB are realized by the present invention.

Figure 13:
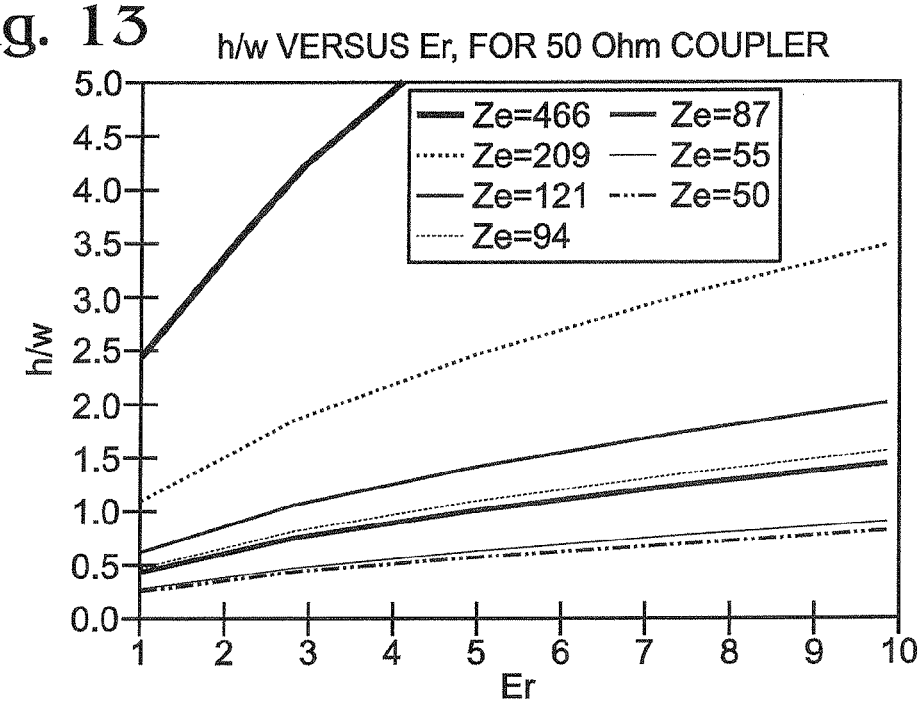
FIG. 13 is a chart comparing selected dielectric material permittivities to another measure of device geometry for multiple even-mode impedance values.

Referring to FIG. 13, a chart showing a comparison of selected dielectric material permittivities relative to the ratio h/w is provided. The dimension w is the width of the broad side of the transmission line employed in the design. The ratio h/w may be exploited to achieve specified even-mode impedance values. Equations for Z, $C_x$, and $C_e$, as a function of dimensions l, w, h, and permittivity, among other factors, were previously provided. Thus:

$$\frac{2C_x}{h} = \frac{\sqrt{\mu_r\varepsilon_r}}{cZ_e} \Leftrightarrow h = \frac{2C_x cZ_e}{\sqrt{\mu_r\varepsilon_r}} \tag{24}$$

because $C_x=\epsilon_0\epsilon_r$, lw⇒ it follows that, $$h = \frac{2\varepsilon_0\varepsilon_r lwcZ_e}{\sqrt{\mu_r\varepsilon_r}} \Leftrightarrow \frac{h}{lw} = \frac{2\varepsilon_0\sqrt{\varepsilon_r}\,cZ_e}{\sqrt{\mu_r}}, \tag{25}$$

$$\text{and since;}\quad c = \frac{1}{\sqrt{\mu_0\varepsilon_0}}$$

$$\frac{h}{lw} = \frac{2\varepsilon_0\sqrt{\varepsilon_r}\,Z_e}{\sqrt{\mu_0\varepsilon_0}\sqrt{\mu_r}} = \frac{2\sqrt{\varepsilon_0\varepsilon_r}\,Z_e}{\sqrt{\mu_0\mu_r}} = \frac{2\sqrt{\varepsilon_0\varepsilon_r}\,Z_e}{\sqrt{\mu_0\mu_r}} = 2\sqrt{\frac{\varepsilon_0}{\mu_0}}\sqrt{\frac{\varepsilon_r}{\mu_r}}\,Z_e \tag{26}$$

Using an approximation for the free space permittivity:

$$\frac{h}{lw} \approx 2\sqrt{\frac{10^{-9}}{\frac{36\pi}{4\pi 10^{-7}}}}\sqrt{\frac{\varepsilon_r}{\mu_r}}\,Z_e = 2\sqrt{\frac{10^{-2}}{4\cdot 36\pi^2}}\sqrt{\frac{\varepsilon_r}{\mu_r}}\,Z_e = 2\sqrt{\frac{1}{12^2\pi^2 10^2}}\sqrt{\frac{\varepsilon_r}{\mu_r}}\,Z_e \Leftrightarrow \frac{h}{lw} \approx 2\frac{1}{120\pi}\sqrt{\frac{\varepsilon_r}{\mu_r}}\,Z_e = \frac{1}{60\pi}\sqrt{\frac{\varepsilon_r}{\mu_r}}\,Z_e, \tag{27}$$

Of interest is the value of ratio h/w per unit length, i.e., for l=1. Note also that for most applications the relative permeability is 1. Accordingly, $$\frac{h}{w} = \frac{1}{60\pi}\sqrt{\varepsilon_r}\,Z_e. \tag{28}$$

For a special case where $\epsilon_r=\pi^2$ (~Alumina) and 3 dB coupling in a 50Ω coupler ($Z_e$≈120Ω). The ratio h/w=2.

FIG. 13 is a plot showing a comparison of h/w ratios relative to various permittivities for several even mode impedance values. Again, these are approximations. The approximations should be multiplied by an adjustment factor based on the plan view geometric configuration. For example, in a tightly wound spiral, the h/w ratio values provided herein should be multiplied by approximately 1.5.

Those of ordinary skill in the art will appreciate that more accurate impedance formulas may be obtained for various coupler configurations using Schwartz-Christoffel transformations or curve fitting techniques. Further, because of the device miniaturization and compactness made possible by the present invention, and typical layout constraints, device performance may be more accurately investigated by way of electromagnetic simulation tools known in the art.

Figure 14:
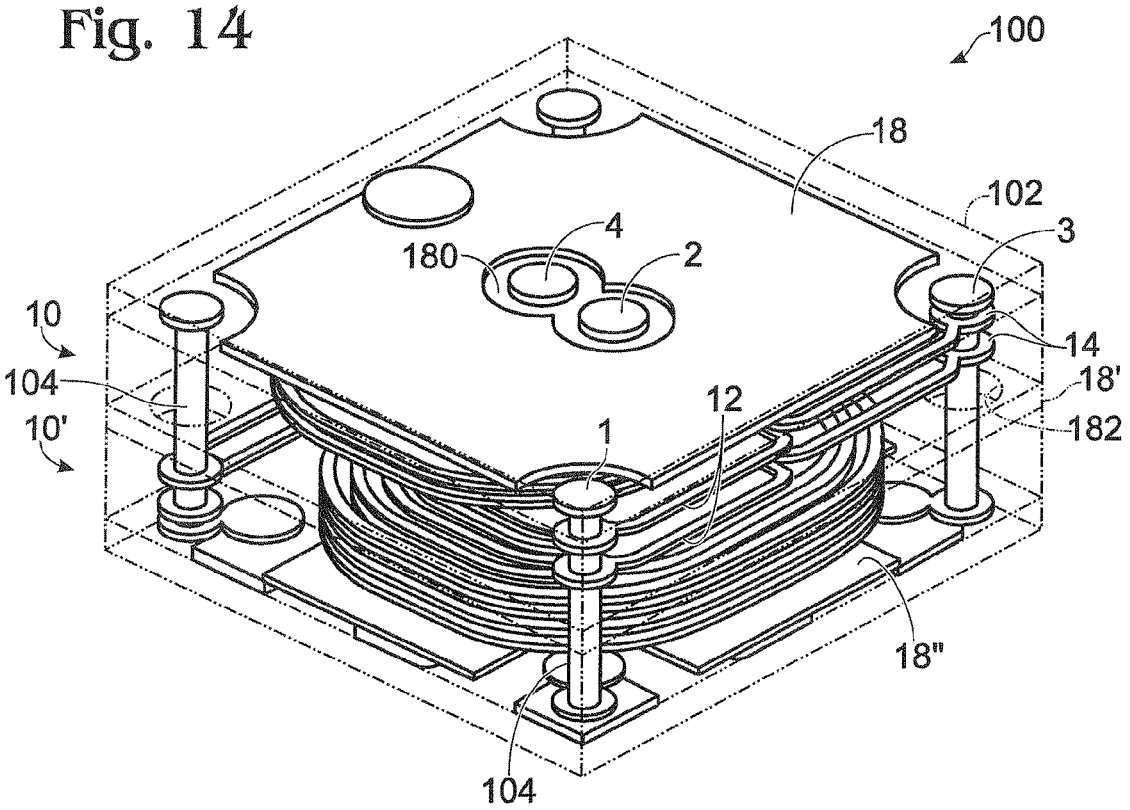
FIG. 14 is a perspective view of a vertical interdigital coupler implementation in accordance with an embodiment of the present invention.

As embodied herein and depicted in FIG. 14, a perspective view of a vertical interdigital coupler implementation 100 in accordance with another embodiment of the present invention is disclosed. Coupler device 100 includes two vertical interdigital couplers 10, 10' in a single compact housing 102. The coupler housing 102 conforms to a form factor having predetermined dimensional specifications that are a function, among other things, of N, the geometrical configuration of the transmission lines, and the selected coupling constant in accordance with the teachings of the present invention described herein.

Coupler 10 occupies the upper-half of device 100 and coupler 10' is disposed in the bottom portion of device 100. Coupler 10 and coupler 10' share ground plate 18'. Thus, coupler 10 is disposed between ground plate 18 and interior ground plate 18° Coupler 10' is disposed between plate 18' and lower ground plate 18". Note that upper ground plate 18 includes interior vias 180 configured to accommodate interior signal transmission paths (not shown) disposed between transmission line 12 and port 2. Vias 180 are also configured to accommodate signal transmission paths disposed between transmission line 14 and port 4. Ground plate 18' includes signal vias 182' disposed along an edge portion of the plate 18'. Vias 182' are configured to accommodate signal transmission paths disposed between transmission line 12, and port 1, and signal transmission paths disposed between transmission lines 14 and port 3. Those of ordinary skill in the art will understand that dielectric layers 16 are disposed between each transmission line 12, 14, or 12', 14'. The dielectric layers 16 are not shown in FIG. 14 for clarity of illustration.

Figure 9C:
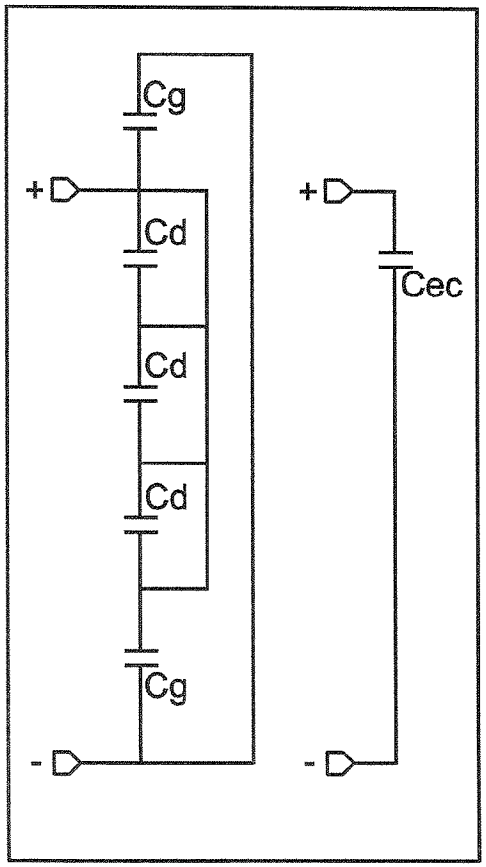
Figure 15:
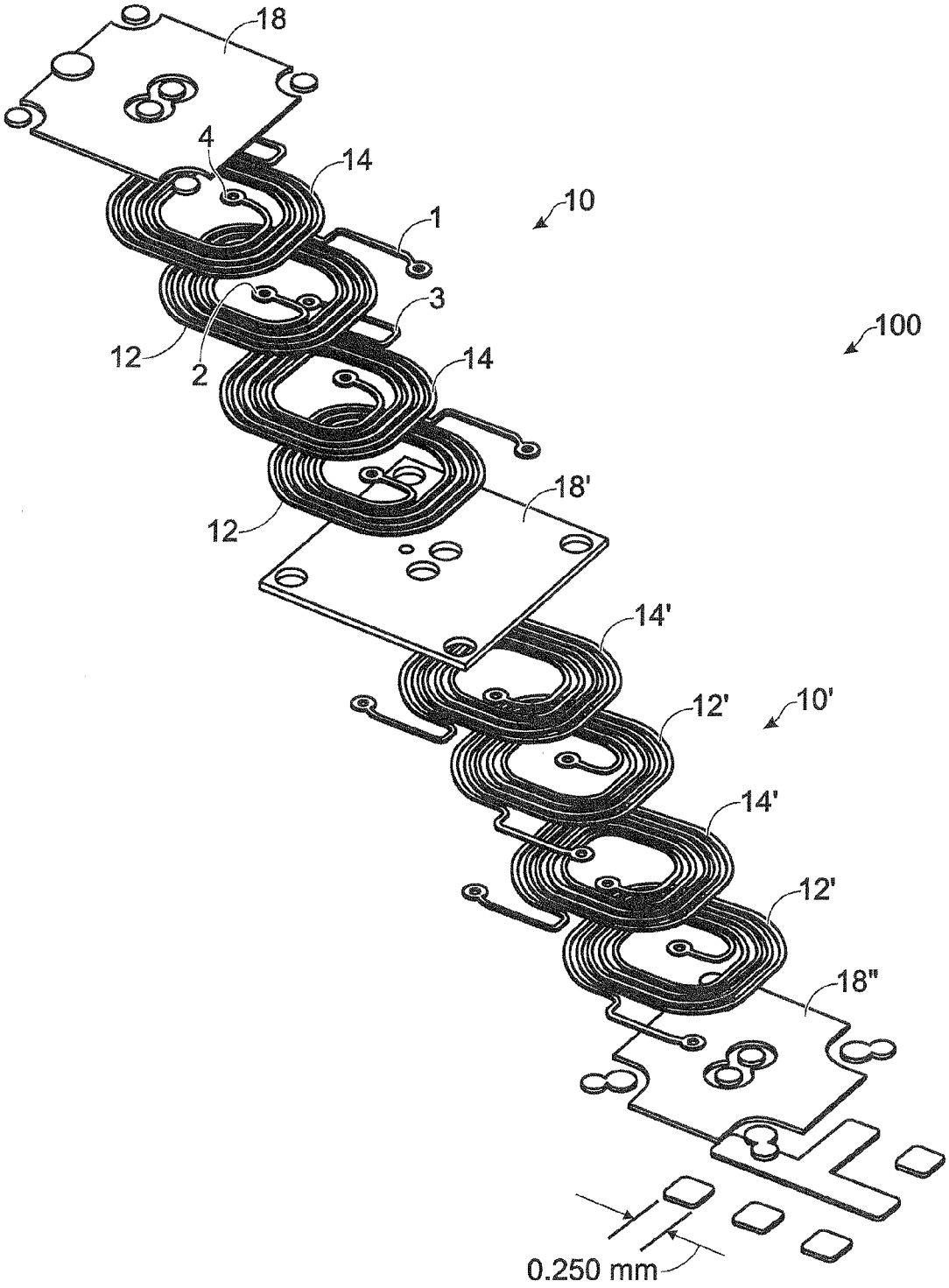
FIG. 15 is an exploded view of the vertical interdigital coupler implementation depicted in FIG. 14.

Referring to FIG. 15, an exploded view of the vertical interdigital coupler implementation 100 is disclosed. Coupler 10 and coupler 10' are identical four port devices. Each vertical interdigital coupler 10 (10') includes four coupled transmission lines, i.e. two main transmission lines 12 (12') interleaved with two secondary transmission lines 14 (14') to form a total of four transmission line layers in each coupler 10 (10'). Thus, each coupler 10 (10') conforms to the schematic diagrams provided in FIGS. 9A-9C. In the exploded view of FIG. 15, it is clearly seen that transmission lines 12 (12') are disposed in vertical alignment with transmission lines 14 (14'). Again, each transmission line is disposed on a dielectric substrate 16 (not shown in this view). Transmission lines 12 are coupled between the port 1 and port 2 to form a transmission line layer. Transmission lines 14 are coupled between port 3 and port 4.

In general, couplers 10 of the present invention may be fabricated in the following manner. As an initial step, the geometric configuration, i.e., the shape of the transmission line in plan view, the width of the conductors, the thickness of the conductors, and all the various spacing dimensions have been calculated. Each transmission line layer is provided as a conductive sheet bonded to a dielectric sheet. Subsequently, the predetermined geometric pattern is transferred to the surface of the conductive sheet using photolithographic techniques. A photoresist material is disposed on the conductive sheet and the pattern is transferred to the resist material by directing radiant energy through a mask. The mask, of course, includes the image of the pattern. Imaging optics disposed in the photolithographic system ensure that the line widths transferred to the surface of the photoresist are properly dimensioned within an appropriate tolerance range. Subsequently, the exposed photoresist material and the underlying portion of the conductive sheet are removed by applying an etchant. The etching provides the transmission line layer including transmission lines 12 (14) disposed on dielectric substrate 16.

Transmission line layer 14 is placed in vertical alignment on transmission line layer 12. Those of ordinary skill in the art will understand that various keying structures and techniques may be employed to ensure that vertical alignment is effected. After alignment, the transmission line layer 12 is bonded to transmission line layer 14. Those of ordinary skill in the art will understand that any suitable bonding technique may be employed depending on the type of dielectric material used to implement dielectric layer 16. For example, with certain polymer dielectric materials, the step of bonding may be performed by applying heat and/or pressure to the sandwiched transmission line layers.

The aforementioned process steps are repeated to form a laminate structure comprising N alternating layers of transmission line layers 12 and transmission line layers 14. Again, N is an integer value greater than or equal to three. After this process step is completed, transmission lines 12 are coupled between port 1 and port 2, and transmission lines 14 are coupled between port 3 and port 4.

Referring back to FIG. 15, the process of fabricating a device having two couplers may be implemented by bonding the interior layers first, and then working outward. In other words, transmission line layer 12 is disposed and aligned to ground plate 18'. Plate 18' is then disposed and aligned to transmission line layer 14'. Heat and pressure may be applied to the three-ply structure (i.e., layer 12, plate 18, and layer 14') to bond these layers together.

In the next step, a layer 14 is disposed on the three-layer laminate structure and a layer 12' is disposed below the laminate structure. Again, the layers are aligned in accordance with the manner previously described. Subsequently, the layers are bonded together to form a five ply structure. This procedure continues until both coupler 10 and coupler 10' have the proper number (N) of transmission line layers. The ports are then connected to the proper transmission lines and the device is disposed in housing 102.

It will be apparent to those of ordinary skill in the pertinent art that modifications and variations can be made to the transmission line layers of the present invention depending on the desired coupling and the desired form factor geometries. Thus, the conductive layer may be formed using any suitable material such as copper, aluminum, gold, platinum, and other such suitable materials. Similarly, the dielectric material may be implemented using various polymer material, a thermoplastic material, a thermoset material, Teflon, or a curable (thermal or UV) resin materials.

Referring back to FIGS. 14-15, an added benefit of the vertically interdigital coupler structures of the present invention relates to the fact that there is a higher percentage of conductive material in the vertical dimension. Obviously, metal is a much better heat conductor than the typical dielectric. Thus, the present invention represents an improvement over the heat transfer characteristics of conventional devices. Additional heat transfer benefits are realized if the profile height is minimized using the vertical interdigital structure of the present invention because the heat conduction path is minimized.

Those of ordinary skill in the art will also understand that different impedances and/or coupling values may be achieved by using other connection schemes between the transmission lines. In one implementation, the designers may leave the transmission line end open. On the other hand, the transmission line may be shorted to obtain a specific impedance, in a manner similar to interdigital filter structures.

Figure 16:
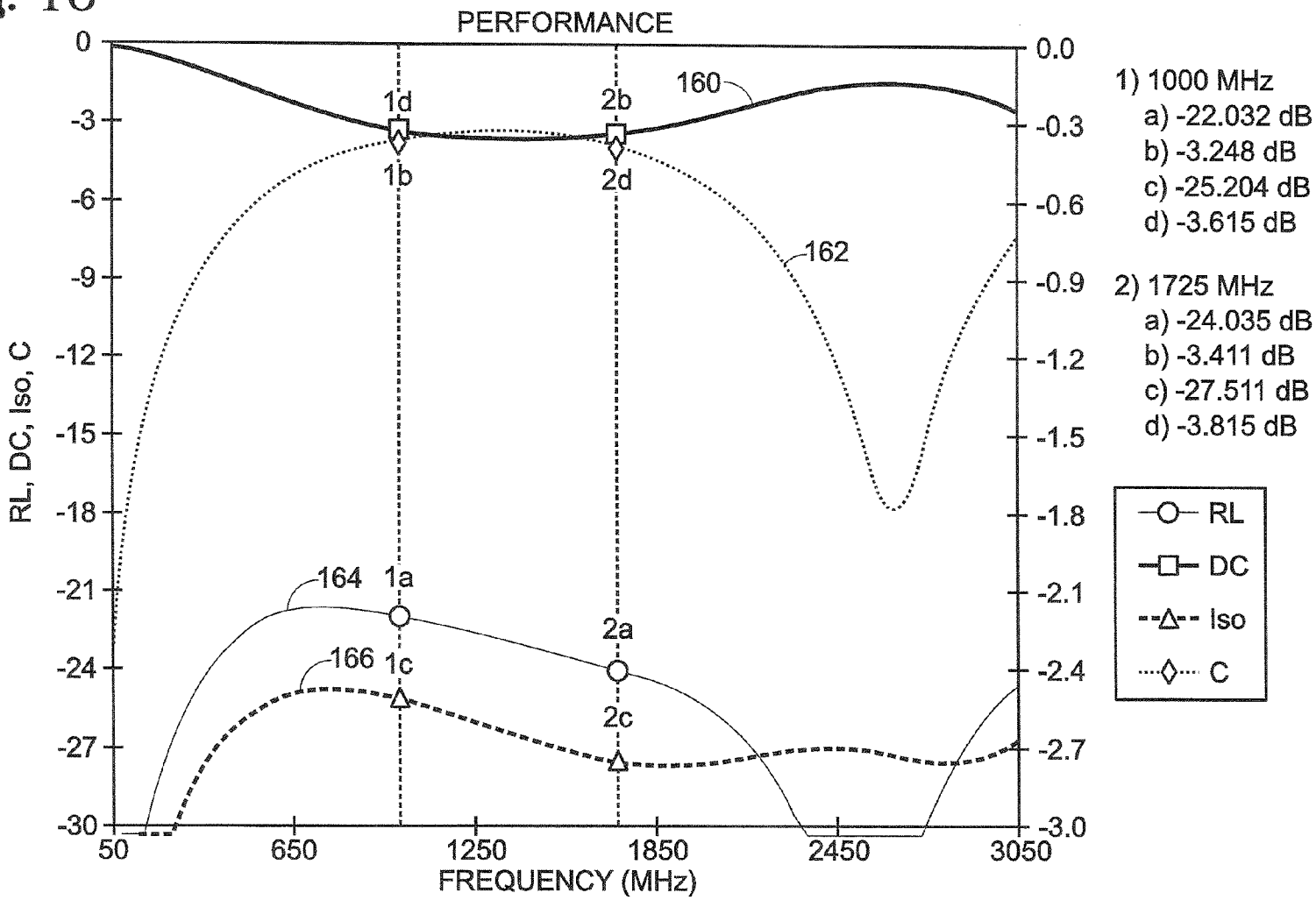
FIG. 16 is a chart illustrating the performance of a coupler depicted in FIGS. 14-15.

Referring to FIG. 16, a chart illustrating the performance of a 3 dB coupler depicted in FIGS. 14-15 is disclosed. The chart provides the performance of coupler 10 at 1.0 GHz and 1.725 GHz. Curve 160 represents the frequency response of the output (port 2) directly connected to main transmission line 12. Curve 162 is the frequency response of the coupled port. As an initial impression, curve 162 shows that the coupled port response is relatively flat in the approximate 750 MHz bandwidth between 1.0 GHz and 1.725 GHz In the 1.0 GHz example, curve 160 (DC) is measured at −3.248 dB below the incident RF signal, whereas curve 162 (C port) is −3.615 dB. Thus, there is a 0.367 dB difference between the nominal 3 dB output ports. The return loss (RL) measured by curve 164 is approximately −22.032 dB below the coupled port output. The isolated port is −25.204 dB below the coupled port output. The performance of coupler 10 at 1.725 GHz is similar. The return loss is −24.035 dB down and the isolation port output is −27.551 dB below the coupled port output.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

What is claimed is:

1. A coupler structure comprising:

a first port, a second port, a third port, and a fourth port accessible via an exterior of the coupler structure;

L first transmission line layers disposed in the coupler structure, each first transmission line layer including a first transmission line conforming to a predetermined geometric configuration, the first transmission line being disposed on a first dielectric material between the first port and the second port, L being an integer; and M second transmission line layers disposed in alternating layers with the L first transmission line layers to form a total of N transmission line layers, M and N being integers with N being greater than or equal to three, each second transmission line layer including a second transmission line substantially conforming to the predetermined geometric configuration, the second transmission line being disposed on a second dielectric material between the third port and the fourth port, each second transmission line being disposed in a predetermined position relative to a corresponding first transmission line within the structure, the coupler structure being characterized by a volume, the volume being a function of N and the predetermined geometric configuration for a selected coupling constant, the volume being inversely proportional to N over a first range of values for N.

2. The coupler structure of claim 1, wherein the predetermined volume is a non-linear function of N.

3. The coupler structure of claim 1, wherein the volume includes a cross-sectional area, the cross-sectional area being a function of N such that the cross-sectional area being inversely proportional to the value of N over a second range of values for N, and wherein the predetermined geometric configuration corresponds to a geometric transmission line pattern and a linewidth of the first transmission line and the second transmission line.

4. The coupler structure of claim 3, wherein the cross-sectional area is is substantially equal to:

$$A_N=(s+w)[2h+(N-1)d+Ntm]; \text{ and}$$

wherein s is a horizontal spacing between adjacent conductors of a first transmission line or a second transmission line, w is a horizontal width of each said conductor, h is a vertical distance from an outermost conductor of the first transmission line or the second transmission line, d is a vertical distance between a first transmission line conductor and a second transmission line conductor, t is a vertical height of each first transmission line conductor and each second transmission line conductor, and m is a ratio in a horizontal direction of conducting material to dielectric material.

5. The coupler structure of claim 1, wherein the predetermined geometric configuration is substantially linear.

6. The coupler structure of claim 1, wherein the predetermined geometric configuration includes at least one substantially rectangular geometric pattern.

7. The coupler structure of claim 1, wherein the predetermined geometric configuration is a non-linear geometric configuration.

8. The coupler structure of claim 1, wherein the predetermined geometric configuration includes at least one meandered line segment.

9. The coupler structure of claim 1, wherein the predetermined geometric configuration includes a spiral configuration.

10. The coupler structure of claim 1, wherein the coupler structure is characterized by a finite even-mode impedance and a finite odd-mode impedance.

11. The coupler structure of claim 10, wherein a ratio of the finite even-mode impedance to the finite odd-mode impedance is substantially within a range between 1:1 to 1:10.

12. The coupler structure of claim 1, wherein the length of each of the first transmission lines and/or each of the second transmission lines is substantially equal to $\lambda/4$.

13. The coupler structure of claim 1, wherein the first transmission lines and the second transmission lines are comprised of a metallic material.

14. The coupler structure of claim 13, wherein the metallic material includes copper.

15. The coupler structure of claim 1, wherein the first dielectric material and/or the second dielectric material is selected from a group of materials that includes a polymer material, a thermoplastic material, a ceramic material, a thermoset material, polytetrfluoroethylene, or a curable resin material.

16. The coupler structure of claim 1, wherein the alternating layers of L transmission line layers and M transmission line layers are disposed between a pair of ground plates.

17. The coupler structure of claim 1, wherein N is greater than or equal to twenty.

18. The coupler structure of claim 1, wherein the selected coupling constant is approximately equal to zero (0) dB.

19. The coupler structure of claim 1, wherein the selected coupling constant is less than or equal to 3 dB.

20. The coupler structure of claim 1, wherein the selected coupling constant is greater than 3 dB.

21. The coupler structure of claim 1, wherein each second transmission line is disposed in substantial vertical alignment with the corresponding first transmission line within the structure.

22. A coupler structure having a form factor characterized by predetermined dimensional specifications, the predetermined dimensional specifications including a cross-sectional area, the coupler structure comprising:

a first port, a second port, a third port, and a fourth port accessible via an exterior of the coupler structure;

L-first transmission line layers disposed in the structure, L being an integer value, each first transmission line layer including a first transmission line conforming to a predetermined geometric configuration, the first transmission line being disposed on a first substrate and coupled between the first port and the second port; and M-second transmission line layers disposed in alternating layers with the L-first transmission line layers to form a total of N transmission line layers, M and N being integers and N being greater than or equal to three, each second transmission line layer including a second transmission line substantially conforming to the predetermined geometric configuration, the second transmission line being disposed on a second substrate and coupled between the third port and the fourth port, each second transmission line being disposed in a predetermined position relative to a corresponding first transmission line within the structure, the predetermined dimensional specifications and the cross sectional area being a function of N and the predetermined geometrical configuration for a selected coupling constant, the cross-sectional area being inversely proportional to N over a range of values for N.

23. The coupler structure of claim 22, wherein the cross-sectional area is a non-linear function of N.

24. The coupler structure of claim 22, wherein the cross-sectional area is substantially equal to:

$$A_N=(s+w)[2h=(N-1)d+Ntm]; \text{ and}$$

wherein s is a horizontal spacing between adjacent conductors of a first transmission line or a second transmission line, w is a horizontal width of each said conductors, h is a vertical distance from an outermost conductor of the first transmission line or the second transmission line, d is a vertical distance between a first transmission line conductor and a second transmission line conductor, t is a vertical height of each first transmission line conductor and each second transmission line conductor, and m is a ratio in a horizontal direction of conducting material to dielectric material.

25. The coupler structure of claim 22, wherein the coupler structure is characterized by a finite even-mode impedance and a finite odd-mode impedance.

26. The coupler structure of claim 25, wherein a ratio of the finite even-mode impedance to the finite odd-mode impedance is substantially within a range between 1:1 to 1:100.

27. The coupler structure of claim 22, wherein the length of each of the first transmission lines and/or each of the second transmission lines is substantially equal to $\lambda/4$.

28. The coupler structure of claim 22, wherein the alternating layers of L transmission line layers and M transmission line layers are disposed between a pair of ground plates.

29. The coupler structure of claim 22, wherein N is greater than or equal to twenty.

30. The coupler structure of claim 22, wherein the selected coupling constant is approximately equal to zero (0) dB.

31. The coupler structure of claim 22, wherein the selected coupling constant is less than or equal to 3 dB.

32. The coupler structure of claim 22, wherein the selected coupling constant is greater than 3 dB.

33. The coupler structure of claim 22, wherein each second transmission line is disposed in substantial vertical alignment with the corresponding first transmission line within the structure.

34. A method for making a coupler structure having a predetermined volume that includes, a predetermined cross-sectional area, the method comprising:

(a) selecting a coupling constant;

(b) determining a geometrical configuration and a value N in accordance with the predetermined volume and the selected coupling constant, N being an integer value greater than or equal to three (3) corresponding to N alternating layers of L first transmission lines and M second transmission lines, L and M also being integers, the predetermined volume being a function of N and the geometric configuration for the selected coupling constant, the predetermined volume being inversely proportional to N over a first range of values for N;

(c) providing a first transmission line layer, the first transmission line layer including a first transmission line disposed on a first dielectric material and conforming to a predetermined geometric configuration;

(d) disposing a second transmission line layer on the first transmission line layer, second transmission line layer including a second transmission line being vertically aligned to the first transmission line and substantially conforming to the predetermined geometric configuration, the second transmission line being disposed on a second dielectric material;

(e) bonding the first transmission line layer and the second transmission line layer;

(f) repeating steps (a)-(e) to form a laminate structure comprising the N alternating layers of the L first transmission line layers and the M second transmission line layers;

(g) coupling a first end of the L first transmission lines to a first port and a second end of the L first transmission lines to a second port; and (h) coupling a first end of the M second transmission lines to a third port and a second end of the M second transmission lines to a fourth port.

35. The method of claim 34 wherein the predetermined volume is a non-linear function of N.

36. The method of claim 34, wherein the step of providing the first transmission line layer further comprises:

providing a conductive sheet bonded to the first dielectric material;

disposing a pattern in accordance with the predetermined geometric configuration on the conductive sheet; and etching the conductive sheet to remove excess conductive material.

37. The method of claim 36, wherein the step of disposing a pattern in accordance with the predetermined geometric shape on the conductive sheet is performed using at least one photolithographic technique.

38. The method of claim 34, wherein the step of bonding is performed by applying heat and/or pressure to the first transmission line layer and the second transmission line layer.

39. The method of claim 36, wherein the conductive sheet is comprised of a metallic material.

40. The method of claim 39, wherein the metallic material is a copper material.

41. The method of claim 34, wherein the first dielectric material and/or the second dielectric material is selected from a group of materials that includes a polymer material, a thermoplastic material, a ceramic material, a thermoset material, polytetrafluoroethylene, or a curable resin material.

42. The method of claim 34, wherein the alternating layers of L transmission line layers and M transmission line layers are disposed between a pair of ground plates.

43. The method of claim 34 wherein the cross-sectional area is substantially equal to:

$$A_N=(s+w)[2h+(N-1)d+Ntm]; \text{ and}$$

wherein s is a horizontal spacing between adjacent conductors of a first transmission line or a second transmission line, w is a horizontal width of each of said conductors, h is a vertical distance from an outermost conductor of the first transmission line or the second transmission line, d is a vertical distance between a first transmission line conductor and a second transmission line conductor, t is a vertical height of each first transmission line conductor and each second transmission line conductor, and m is a ratio in a horizontal direction of conducting material to dielectric material.

44. The method of claim 34, wherein the length of each of the first transmission lines and/or each of the second transmission lines is substantially equal to $\lambda/4$.

* * * * *